US006122786A

United States Patent [19]

Ball

[11] Patent Number: 6,122,786

[45] Date of Patent: Sep. 26, 2000

[54] INFLATABLE MATTRESSES

[75] Inventor: Graham Ball, Great Dunmow, United Kingdom

[73] Assignee: Rober Limited, Branston, United Kingdom

[21] Appl. No.: 09/230,599

[22] PCT Filed: Jul. 29, 1997

[86] PCT No.: PCT/GB97/02041

§ 371 Date: Jan. 27, 1999

§ 102(e) Date: Jan. 27, 1999

[87] PCT Pub. No.: WO98/05246

PCT Pub. Date: Feb. 12, 1998

[30] Foreign Application Priority Data

Aug. 6, 1996 [GB] United Kingdom ..... 9616524

[51] Int. Cl.[7] ..... A47C 27/10

[52] U.S. Cl. ..... 5/710; 5/706; 5/713; 5/655.3

[58] Field of Search ..... 5/689, 706, 710, 5/933, 655.3, 711, 712, 713

[56] References Cited

U.S. PATENT DOCUMENTS 1,089,652 3/1914 Lisbae ..... 5/710

5,966,761 10/1999 Williams ..... 5/706

*Primary Examiner*—Terry Lee Melius

*Assistant Examiner*—Fredrick Conley

*Attorney, Agent, or Firm*—Lee, Mann, Smith, McWilliams, Sweeney & Ohlson

[57] ABSTRACT

An inflatable mattress for supporting patients comprises two inflatable longitudinal tubes extending along the respective longitudinal edges of the mattress and a plurality of inflatable transverse tubes. Each transverse tube has adjacent its end an aperture, with the longitudinal tube extending through the aligned apertures at one side of the mattress and the longitudinal tube extending through the aligned apertures at the other side of the mattress. The transverse tubes are selectively inflatable in various modes under microprocessor control.

11 Claims, 4 Drawing Sheets

INFLATABLE MATTRESSES

This invention relates to inflatable mattresses for supporting patients.

Inflatable mattresses of this sort are disclosed in British Patent Specifications Nos 1595417 and 2241164. The invention aims to provide a novel configuration of inflatable mattress having longitudinal side tubes for providing support at the edges of the mattress.

According to the invention an inflatable mattress comprises two inflatable longitudinal tubes extending along the respective longitudinal edges of the mattress and a plurality of inflatable transverse tubes spanning the longitudinal tubes, each transverse tube having, at or adjacent each end and at an inter-mediate location between its upper and lower edges, an opening which extends through the transverse tube, each longitudinal tube passing through the openings at the corresponding ends of the transverse tubes.

Each opening may be a slot but is preferably an aperture extending through the corresponding transverse tube. Hence, each longitudinal tube passes through the corresponding end of each transverse tube, so as to locate the longitudinal and transverse tubes and retain them in their required positions.

The transverse tubes may comprise two series of tubes, namely a first series of transverse tubes, and a second series of tubes which are inflatable independently of the first series and of the longitudinal tubes. The first series may consist of any chosen number (preferably between two and five) of adjacent transverse tubes at one end of the mattress, these forming so-called head cells at the head end of the mattress. These head cells may be connected to the two longitudinal tubes to form a common volume therewith, so that the head cells and longitudinal tubes are inflatable or deflatable together. The second series of tubes may be connected so as to form a plurality of groups, the tubes of the groups being in an interdigitated array and with each group being independently inflatable with respect to remaining groups, the tubes of each group being inflated and deflated in a sequence to vary the positions at which supporting pressure is applied to a patient lying on the bed, so as to minimise or reduce the risk of bedsores.

When inflated, each transverse tube may be generally dumbbell shaped in transverse cross-section, having bulbous upper and lower regions between which is an intermediate web region having the apertures.

Each transverse tube is preferably fabricated from a single sheet of material, being sealed to form an inflatable tube and being sealed around the margins of the apertures.

The inflatable mattress may include inflatable means including a compressor, a pressure sensor for sensing the pressure to which the longitudinal tubes are inflated and control means which control the compressor in dependence upon the pressure sensed by the sensor.

A mattress according to the invention will now be described, by way of example, with reference to the accompanying drawings, in which.

Figure 1:
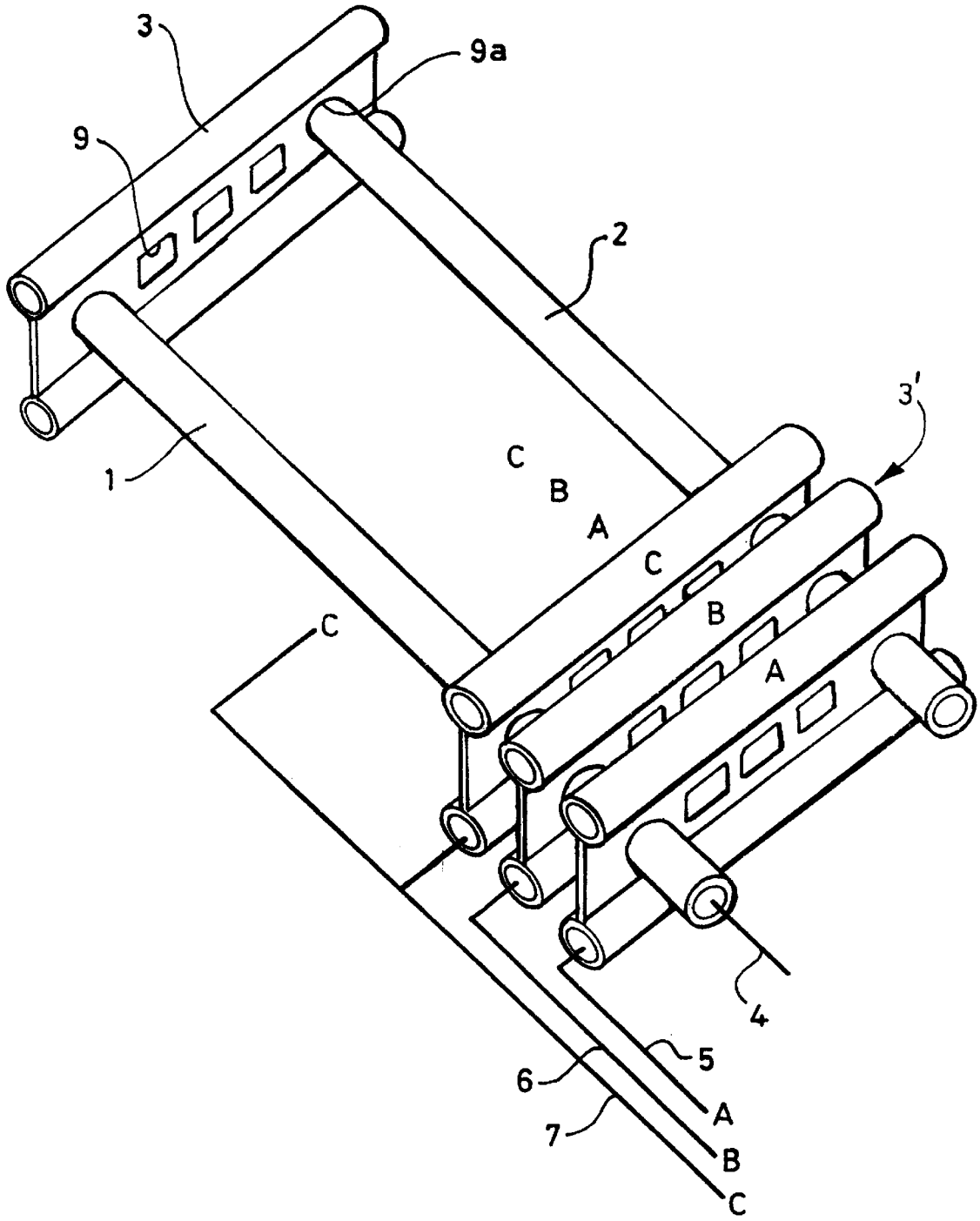
FIG. 1 is a perspective view of a mattress.
Figure 2:
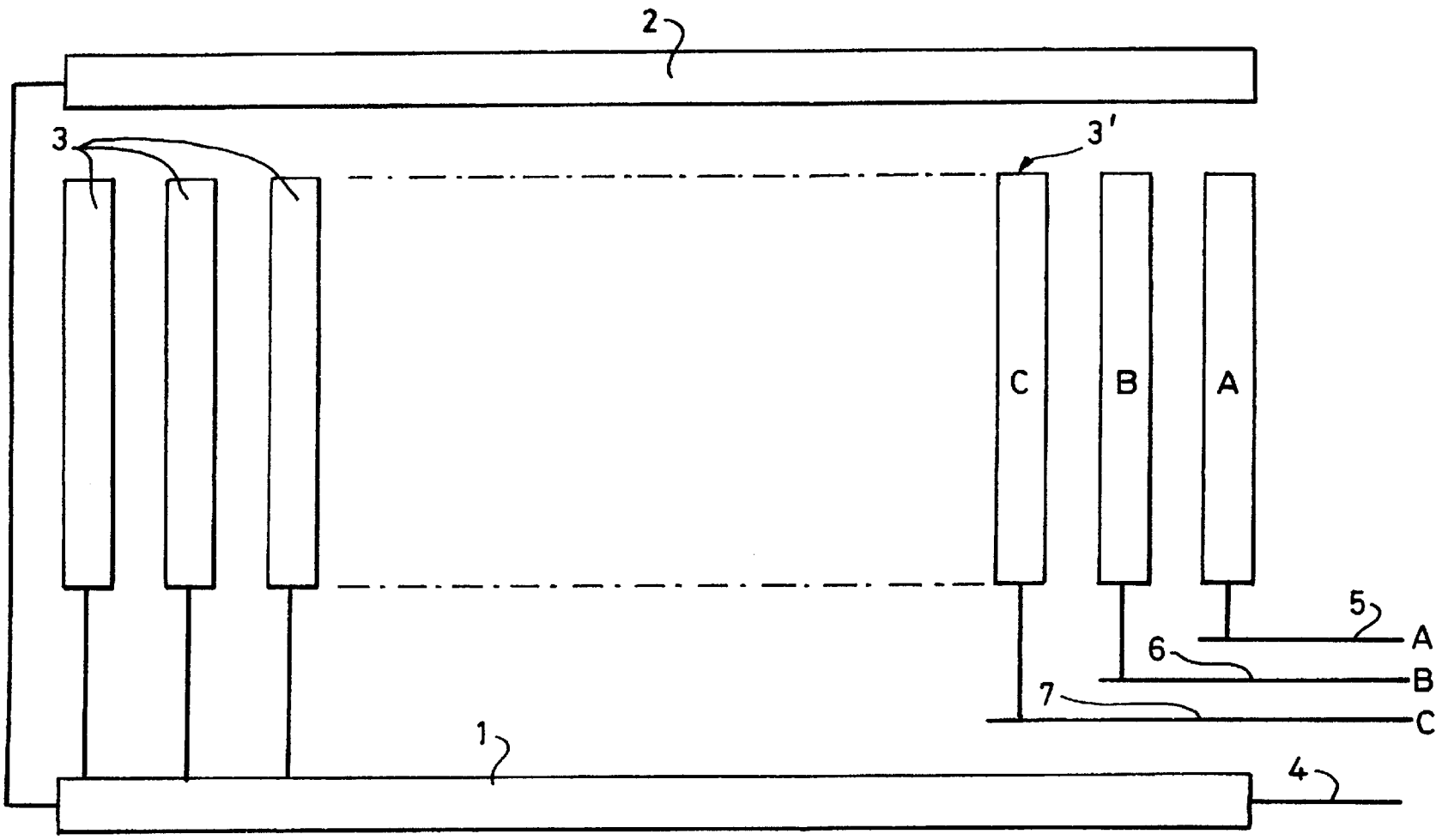
FIG. 2 is a diagrammatic view of the mattress.

Referring to FIGS. 1 and 2, the mattress comprises two longitudinal tubes 1, 2 extending along respective side edges of the mattress. The tubes 1, 2 constitute side formers and define the mattress edges. Spanning the two tubes are a plurality of inflatable transverse tubes arranged in two series. The first series of three transverse tubes form head cells 3 and extend across the mattress at the end thereof intended to be the head end of the mattress. The tubes 3 are connected to one another and to the two longitudinal tubes 1, 2, and thus the tubes 1, 2 and 3 are inflatable and deflatable together, by means of a supply tube 4. Alternatively, the head cells 3 may be inflatable or deflatable separately of the longitudinal tubes 1, 2 by the use of valves. For example, the head cells 3 may be left deflated (or some deflated and some inflated) so that the patient's head is unsupported or spans a region lacking support.

The remaining transverse tubes 3' form a second series, extending across the mattress for the remainder of the length thereof. The second series of tubes 3' are arranged in three groups respectively designated ABC. The tubes of the groups are arranged in a repeating sequence ABC, ABC . . . in the longitudinal direction of the mattress. All the tubes of group A are interconnected and are inflatable and deflatable together by means of a supply tube 5, all the tubes of group B are similarly interconnected and inflatable or deflatable together by means of a supply tube 6 and all the tubes of group C are interconnected and inflatable/deflatable together by means of a supply tube 7. In the exemplary mattress of FIGS. 1 and 2 there are five tubes in each of groups A, B and C.

Figure 3:
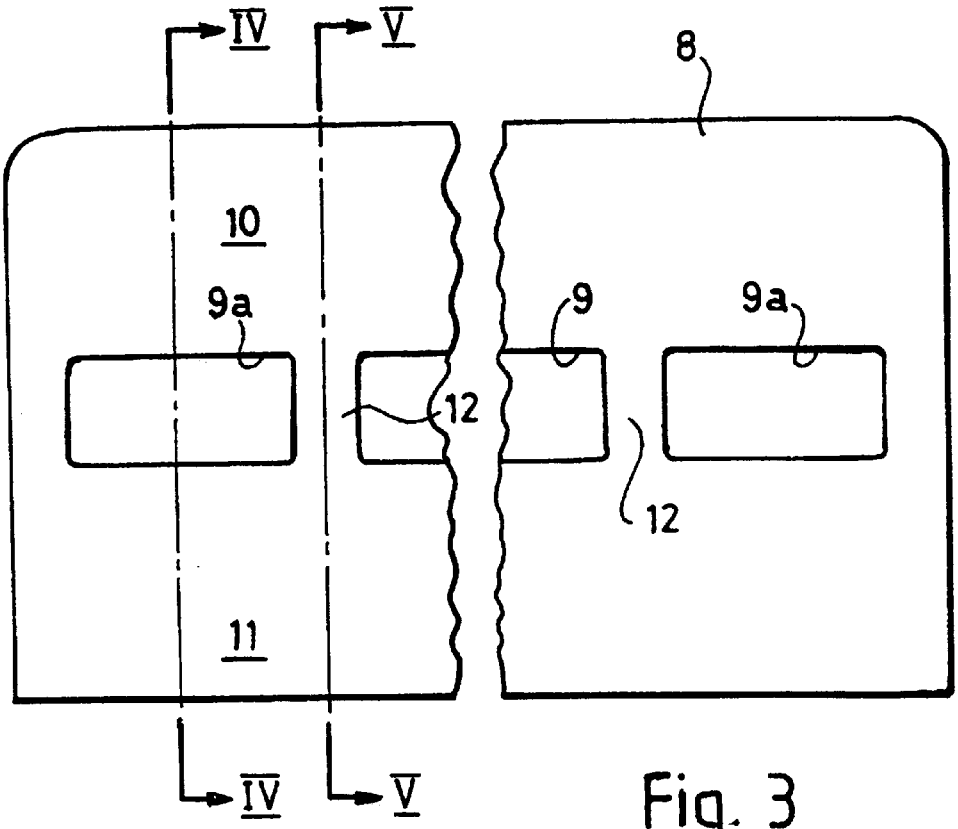
FIG. 3 is a side elevation of one of the transverse tubes of the mattress.
Figure 4:
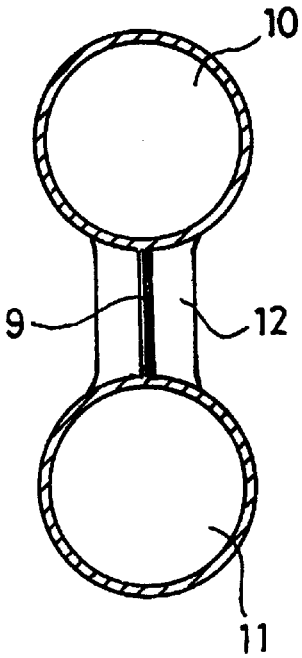
FIGS. 4 and 5 are sectional views on the lines IV—IV and V—V respectively of FIG. 3.
Figure 5:
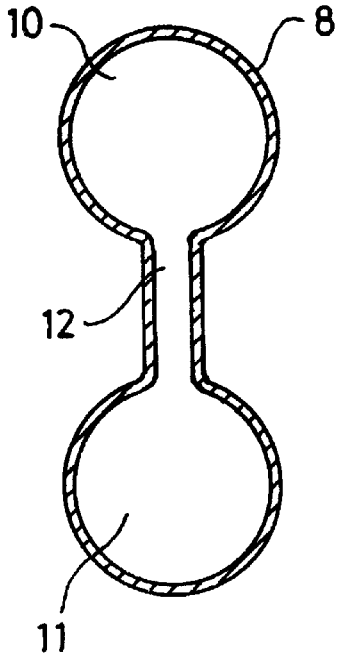

Each transverse tube 3 or 3' has the shape shown in FIGS. 3, 4 and 5. A single panel 8 of air impermeable sheet material is folded and sealed along meeting edges to form the tube enclosure. Along its length, each transverse tube 3 or 3' has a plurality of spaced rectangular heat seals 9 where facing surfaces on the sheet material are heat sealed together, imparting to the inflated tube the dumbbell shape shown in FIGS. 4 and 5. Each inflated transverse tube thus has an upper bulbous portion 10, a lower bulbous portion 11 and an-intermediate web region having the heat seals 9. Between the heat seals 9 are interconnecting regions 12. It will be appreciated that the portions 10 and 11 and regions 12 form a common inflatable volume for that tube. This gives to the tube the necessary vertical elongation which provides adequate support to the patient without "bottoming". At each end of each transverse tube 3 or 3' the material within the rectangular heat seal is removed to form an aperture 9*a*. The material within the remaining heat seals 9 is left in place. Instead of such remaining heat seals 9, the sheet material between the two apertures 9*a* of each tube 3 or 3' may be head welded together, eg by horizontal welds spanning the apertures 9*a*. In this case the regions between each aperture 9 and the end of the tube 3 or 3' serve to provide internal communication between the portions 10 and 11.

The apertures 9*a* at the ends of the transverse tubes on one side of the mattress are aligned and the corresponding longitudinal tube 1 extends through these aligned apertures 9*a*. Similarly, on the other side of the mattress the apertures 9*a* at the ends of the transverse tubes are aligned and the other longitudinal tube 2 extends through these aligned apertures 9*a*. Hence, the main area of the mattress is formed by the abutting transverse tubes 3 or 3' , with the respective side edges of the mattress being defined by the longitudinal tubes 1, 2 which provide longitudinal support at the sides of the mattress and act to minimise any tendency for a patient to fall or roll off the mattress unintentionally. The transverse tubes 3, 3' may be retained in close side-by-side relationship by means of retaining loops which pass under and over the tubes 3, 3' in a serpentine configuration, each loop being made of a non-stretch, flexible material.

The longitudinal tubes 1, 2 may be of any convenient cross-sectional shape, eg circular or oval (with the larger dimension vertical). Where the tubes 1, 2 extend through the apertures 9*a*, the cross-sectional shape of the tube 1, 2 is constrained by the aperture shape.

Figure 6:
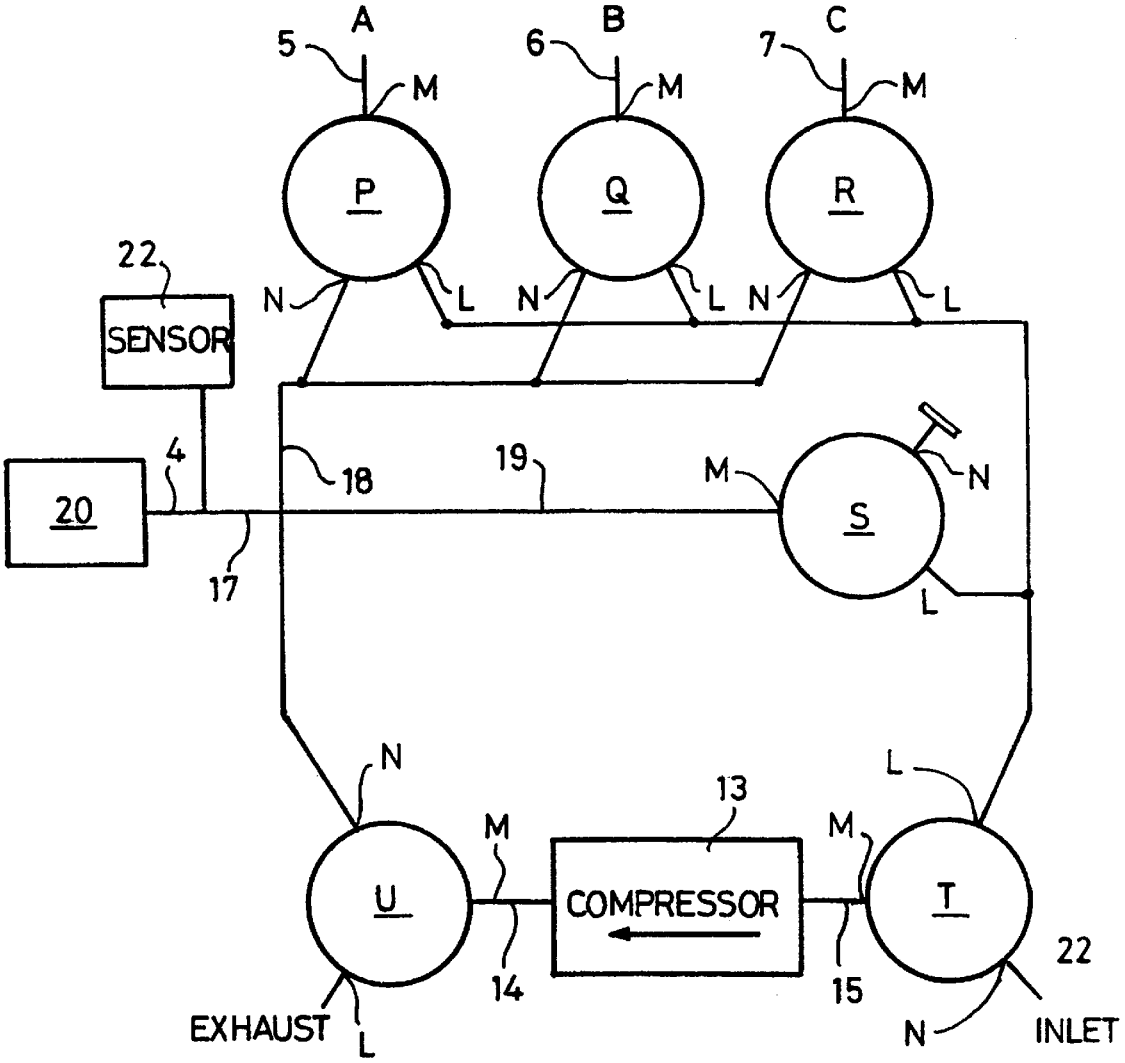
FIG. 6 is a diagram showing a system for inflating the mattress.

FIG. 6 is a diagram of the pneumatic circuit for inflating and deflating the mattress. An electrically driven compressor 13 has a pressure side 14 and a suction side 15. The pressure side 14 is connected, through the intermediary of a valve U, to three pressure supply tubes 17, 18 and 19. The valve U has one port L leading to exhaust. The supply tube 17 is connected to the supply tube 4 feeding the tubes 1, 2 and 3. The inflatable space of the tubes 1, 2 and 3 is indicated by the numeral 20 in FIG. 6. The supply pipe 18 leads to three valves P, Q and R which respectively serve the supply tubes 5, 6 and 7. The tube 19 is connected to a valve S. Air is drawn into the suction side 15 of the compressor 13 from an inlet 22, through a valve T. A pressure sensor 22 detects pressure in the inflatable volume 20.

Each valve P, Q, R, S, T, U has three ports L, M and N and is essentially bistable, occupying either a first state in which ports M and N are in communication or a second state in which ports L and M are in communication. If the first state is designated X and the second state Y, the various modes of operation can be summarised as follows:

Operation of a "Mode" control button on a control panel enables a "Static Mode" to be selected. In this condition all the tubes remain inflated on a continuous basis, no cycling occurs and the compressor only operates to compensate for any minor leaks in the system. As in the Dynamic Mode the tube inflation pressure may be varied to provide a range of comfort settings. The Static Mode is automatically limited to a maximum duration of two hours at the end of which the system reverts to Dynamic operation (which is clinically safer as it provides better pressure relief).

A third mode of operation can be selected to permit nursing procedures to be carried out on a stable surface. In this "Physiotherapy" Mode the mattress is continuously inflated as in Static operation but the inflation pressure is increased to 65 mmHg which provides a very firm surface to the mattress. This mode of operation is normally limited to a maximum of twenty minutes after which the system automatically reverts to Dynamic cycling at the lower inflation pressure of 50 mmHg.

In all situations the mode and comfort setting are displayed by an L.C.D. control panel. Hence, the panel shows Dynamic-Firm or Static-Soft etc.

In addition to the normal operating modes the system will automatically compensate for the increase in mattress inflation pressure which occurs when the patient is first placed on the mattress. The pressure increase is sensed by the sensor 22 and air is vented to atmosphere until the correct inflation is achieved, usually within a few seconds. This is indicated by "Overpressure Reduction" in the above table.

| | VALVE STATUS | | | | | | |
|---|---|---|---|---|---|---|---|
| MODE | P | Q | R | S | T | U | COMMENTS |
| Inflate All | X | X | X | X | X | X | Compressor on, cycled on/off as required |
| Static | X | X | X | X | X | X | Compressor; cycled on/off as required |
| Static (Increase) | X | X | X | X | X | X | As "Inflate All" |
| Static (Decrease) | Y | Y | Y | Y | Y | Y | Compressor on |
| Overpressure Reduction | Y | Y | Y | Y | Y | Y | Compressor on |
| Deflate "A" Cells | Y | X | X | X | Y | Y/X | Compressor on, T on for 40 seconds. U on/off to maintain pressure in B, C cells and reservoir 20 |
| Hold "A" Cells deflated | Y | X | X | X | X | Y/X | Compressor and U on/off to maintain pressure in B, C cells and reservoir 20 |
| Inflate "A" Cells | X | X | X | X | X | X | Compressor on, cycled on/off as required |
| Deflate "All" cells | Y | Y | Y | Y | Y | Y | Compressor on |

The mattress comprises control means, including a microprocessor, which controls operation of the valves P, Q, R, S, T, U in dependence upon the operative mode.

When first switched on the compressor 13 runs continuously and air is directed into all the transverse tubes 3, 3' and also the longitudinal tubes 1, 2. When the pressure in the tubes 1, 2 reaches 50 mm Hg (as detected by the sensor 22 ) the system goes automatically into the "Dynamic Cycling Mode" and the "Firm" comfort setting. In this mode the transverse tubes A, B and C are deflated and related in turn while the tubes 1, 2 and the tubes 3 remain inflated throughout. Each group of tubes A, B or C undergoes an inflation/deflation cycle in between seven and ten minutes, it being understood that the cycles for the three groups occur successively in time. The pressure in the inflated tubes may be varied by means of a comfort control which permits the inflation pressure to be changed to any of three preselected values ie 20, 35 and 50 mmHg (soft, normal and firm) according to patient need or preference.

When the patient is removed from the mattress the latter can be deflated by selecting the deflation mode in which air is extracted from the mattress via the air compressor 13. This mode operates for a fixed period of between fifteen and twenty minutes, at the end of which the system is automatically shut down.

The stated pressures and times are exemplary and may be varied for clinical reasons.

What is claimed is:

1. An inflatable mattress comprising two inflatable longitudinal tubes extending along the respective longitudinal edges of the mattress and a plurality of inflatable transverse tubes spanning the longitudinal tubes, each transverse tube having, at or adjacent each end and at an intermediate location between its upper and lower edges, an opening which extends through the transverse tube, each longitudinal tube passing through the openings at the corresponding ends of the traverse tubes, and in which the transverse tubes comprise two series of tubes, namely a first series of transverse tubes, and a second series of traverse tubes which are inflatable independently of the first series and of the longitudinal tubes.

2. An inflatable mattress according to claim 1, wherein each opening is an aperture extending through the corresponding transverse tube.

3. An inflatable mattress according to claim 1, wherein the first series of tubes consist of two, three, four or five adjacent transverse tubes at one end of the mattress, these forming head cells at the head end of the mattress.

4. An inflatable mattress according to claim 3, wherein the head cells are connected to the two longitudinal tubes to form a common volume therewith, so that the head cells and the longitudinal tubes are inflatable or deflatable together.

5. An inflatable mattress according to claim 3, wherein the second series of tubes are connected so as to form a plurality of groups, the tubes of the groups being in an interdigitated array and with each group being independently inflatable with respect to remaining groups, the tubes of each group being inflated and deflated in a sequence to vary the positions at which supporting pressure is applied to a patient lying on the bed, so as to minimise or reduce the risk of bedsores.

6. An inflatable mattress according to claim 1, wherein each transverse tube when inflated is generally dumbbell shaped in transverse cross-section, having bulbous upper and lower regions between which is an intermediate web region having said apertures therein.

7. An inflatable mattress according to claim 1, wherein each transverse tube is fabricated from a single sheet of material, being sealed to form an inflatable tube and being sealed around the margins of the apertures.

8. An inflatable mattress according to claim 1, wherein the inflatable mattress includes inflatable means including a compressor, a pressure sensor for sensing the pressure to which the longitudinal tubes are inflated and control means which control the compressor in dependence upon the pressure sensed by the sensor.

9. An inflatable mattress according to claim 8, wherein the inflatable means compensate for an increase in mattress inflation pressure when a patient is first placed on the mattress by venting of the inflated tubes to atmosphere until the pressure sensor senses a required inflation pressure.

10. An inflatable mattress according to claim 8, wherein the control means include selectable means enabling the inflation pressure to be maintained at a selected value out of a plurality of possible values.

11. An inflatable mattress according to claim 10, wherein the selectable means additionally enable a desired mode to be selected out of a plurality of possible modes including a static mode, in which all the inflatable tubes remain inflated at the selected pressure value, and a dynamic mode in which the tubes of each group are inflated and deflated in said sequence.

* * * * *